US006213204B1

(12) United States Patent
Doane

(10) Patent No.: US 6,213,204 B1
(45) Date of Patent: Apr. 10, 2001

(54) HIGH LOAD, THIN SLIP SYSTEM

(75) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/206,629

(22) Filed: Dec. 7, 1998

(51) Int. Cl.[7] ..... E21B 23/06

(52) U.S. Cl. ..... 166/134; 166/138; 166/140; 166/217

(58) Field of Search ..... 166/134, 138, 166/140, 216, 217

(56) References Cited

U.S. PATENT DOCUMENTS

| | | | |
|---|---|---|---|
| Re. 30,988 | * | 7/1982 | Crickmer . |
| 2,735,497 | | 2/1956 | Brumleu et al. . |
| 3,910,348 | | 10/1975 | Pitts . |
| 4,359,090 | | 11/1982 | Luke . |
| 4,523,641 | * | 6/1985 | Manderscheid . |
| 4,576,230 | | 3/1986 | Tapp et al. . |
| 4,595,052 | | 6/1986 | Kristiansen . |
| 4,711,326 | | 12/1987 | Baugh et al. . |
| 4,750,563 | * | 6/1988 | Baugh . |
| 4,762,177 | * | 8/1988 | Smith, Jr. . |
| 5,086,845 | | 2/1992 | Baugh . |
| 5,449,040 | | 9/1995 | Milner et al. . |
| 5,487,427 | | 1/1996 | Curington . |
| 5,647,437 | | 7/1997 | Braddick et al. . |
| 5,720,343 | | 2/1998 | Kilgore et al. . |

FOREIGN PATENT DOCUMENTS

| | | |
|---|---|---|
| 2323869 | 10/1998 | (GB) . |

* cited by examiner

*Primary Examiner*—David Bagnell
*Assistant Examiner*—Meredith C. Petravick
(74) *Attorney, Agent, or Firm*—Duane, Morris & Heckscher LLP

(57) ABSTRACT

A high-load slip system allows better transmission of loads from the slips to the body. The cone comprises longitudinal slots and the body comprises tabs which are disposed in those slots. The load is transferred from the slips to the cone and into the tabs which reside in the slots. The arrangement can be configured to share the load between the tabs extending from the body and the actual body itself after a small amount of collapse on the cone, leaving the body to support the cone, both through the tabs and on the outside diameter.

16 Claims, 5 Drawing Sheets

HIGH LOAD, THIN SLIP SYSTEM

FIELD OF THE INVENTION

The field of this invention relates to slip systems for downhole packers, particularly those that require a high load from uphole or downhole directions.

BACKGROUND OF THE INVENTION

Slip systems are typically used to anchor packers to the casing. A typical slip system comprises a cone, slips and a body. The cone is typically a cylindrical component which has a shallow angle cut on the outside diameter of one end. The slips are segments cut from a cylinder and have the same angle as the cone on the inside diameter, as well as sharp teeth on the outside face. The cone and slips slide over the body, which is also cylindrical. When the packer is set, the cone pushes against the slips through the shallow angle, causing them to move radially until the sharp teeth contact the casing. Load applied to the packer is transmitted to the cone, which causes the slips to bite deeper into the casing to prevent the packer from moving. Therefore, in most slip systems, a radial load is applied to the cone when the packer is loaded due to the angles cut on the cone and slips. If the load applied to the packer is great enough, the cone will collapse until the inside diameter of the cone contacts the outside diameter of the body. At times, the applied load can cause the body to collapse. The limitation of the amount of load a packer can hold is often determined by when the cone collapses onto the body, causing it to collapse. Thinner slip systems, because of their reduced cross-section, are less resistant to collapse from the applied radial load and hold less force than thicker systems. However, thick slip systems have a disadvantage of requiring additional space, which decreases the available bore size in the packer for a given casing size.

Another design which has been used in the past on packers is illustrated in FIGS. 1–3, as well as in U.S. Pat. No. 4,711,326. FIG. 1 is a perspective of a slip without the wickers, illustrating opposed beveled surfaces 10 and 12. Each of those surfaces has an elongated tab 14 and 16, respectively. Referring to FIGS. 2 and 3, the elongated tabs 14 and 16 ride in grooves 18 and 20. Grooves 18 and 20 are wider than the width of the tabs 14 and 16 to allow easy movement for guiding the slip 22 along the cone 24. As seen in FIG. 3, the cone 24 has opposed surfaces 26 and 28 which are disposed to engage the beveled surfaces 10 and 12 on slip 22 shown in FIG. 1. Thus, the extension of the tabs 14 and 16 into grooves 18 and 20 serves to guide the slip 22 with respect to cone 24, while at the same time the engagement of the beveled surfaces 10 and 12 on slip 22 to surfaces 26 and 28 of cone 24 acts to transfer the radial load from the casing through the slip 22 into the cone 24. Because of the beveled cut on surfaces 10 and 12, a near-circumferential component of the radial force applied to the slips 22 is communicated into the cone 24. This design has been used traditionally to hold forces from only one direction and in permanent installations. The present invention is more suitable for retrievable packers and systems which need to hold forces from both directions (bidirectional). The present invention retrieves because there is only one angle between the slip and cone instead of the combined angles in the prior art shown in FIGS. 1–3. This combined angle causes a wedging effect between the slips and cone which increases the retrieval force. Tests have shown that in some cases, the retrieval force is so high that the tails 15 are pulled off the ends of the slips due to a tensile failure at narrow region 17 (see FIG. 1). When this happens, the slips cannot be retrieved.

In the preferred embodiment, the present invention uses bidirectional slips which have a ramp angle on each end. The prior art slips of FIGS. 1–3 only have a ramp angle on one end. The prior art system of FIGS. 1–3 is not readily convertible to a bidirectional design, and even if it could be, it would still be very costly, highly complex, and not as reliable as the present invention.

These and other advantages of the present invention will be more readily understood by those skilled in the art from a review of the preferred embodiment described below.

SUMMARY OF THE INVENTION

A high-load slip system allows better transmission of loads from the slips to the body. The cone comprises longitudinal slots and the body comprises tabs which are disposed in those slots. The load is transferred from the slips to the cone and into the tabs which reside in the slots. The arrangement can be configured to share the load between the tabs extending from the body and the actual body itself after a small amount of collapse on the cone, leaving the body to support the cone, both through the tabs and on the outside diameter.

DETAILED DESCRIPTION OF THE PREFERRED EMBODIMENT

Figure 6:
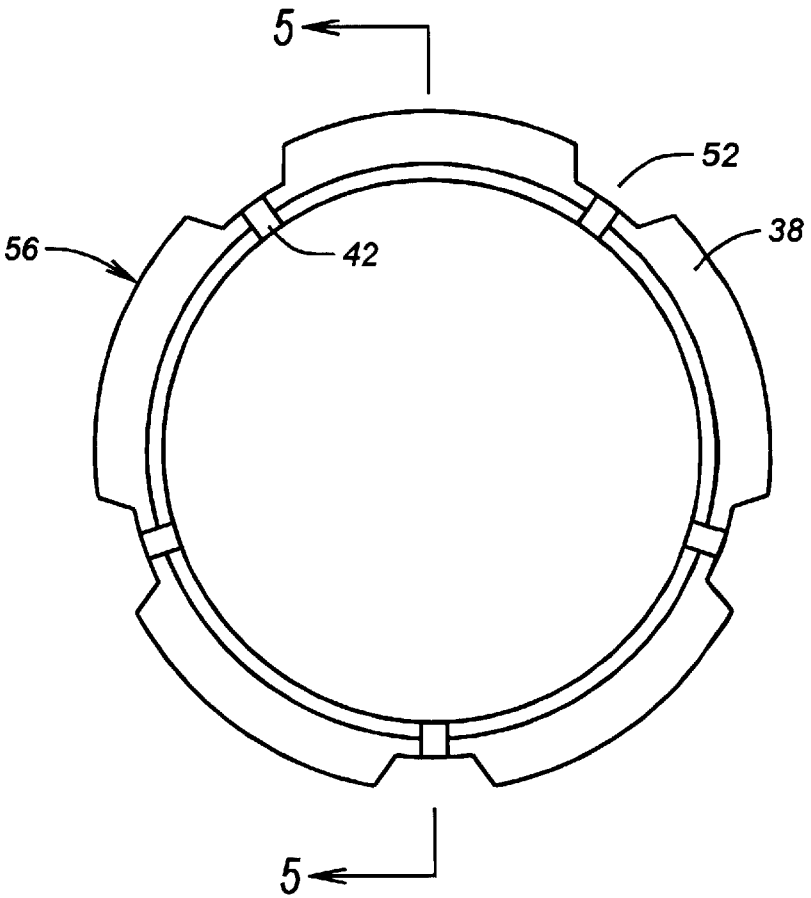
FIG. 6 is an end view of the cone in FIG. 5.
Figure 5:
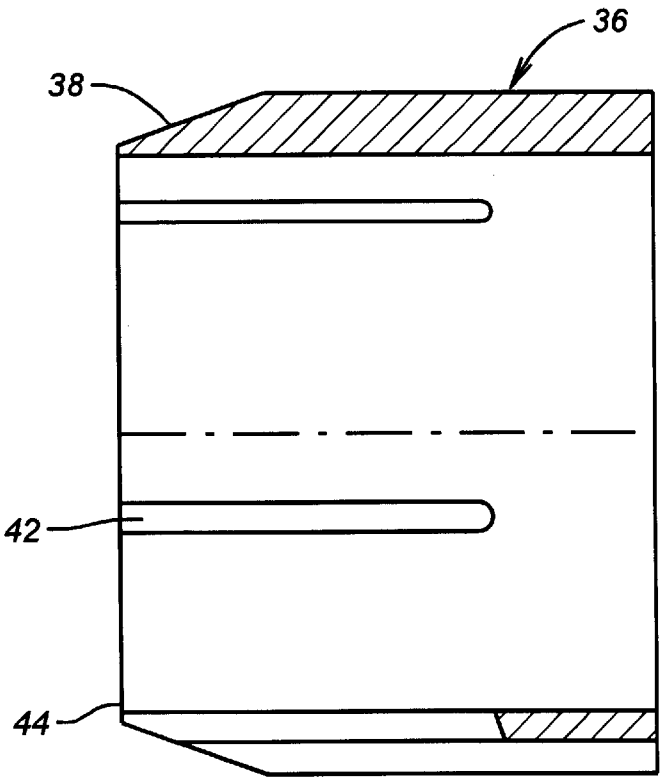
FIG. 5 is a section view of one of the cones shown in FIGS. 4*a–b*, taken along lines 5—5 of FIG. 6.
Figure 7:
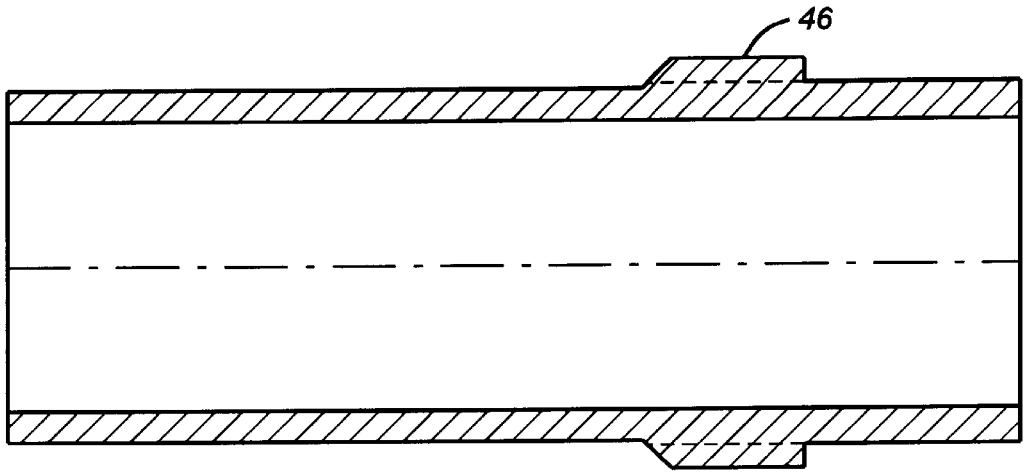
FIG. 7 is a section view of a portion of the body of the downhole tool shown in FIGS. 4*a–b* and taken along lines 7—7 of FIG. 8.
Figure 8:
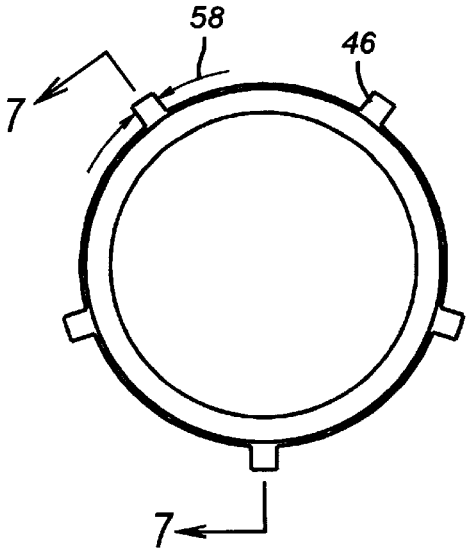
FIG. 8 is an end view of FIG. 7.
Figure 9:
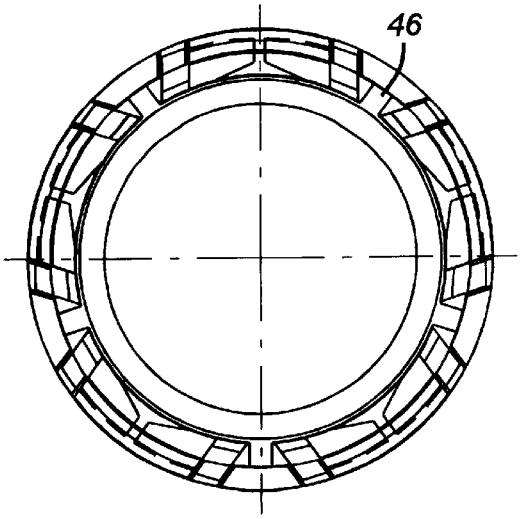
FIG. 9 is a sectional view showing the tab extending into the slot of the cone.

Referring to FIG. 4, the slip system for any given downhole tool, such as a packer or bridge plug, is illustrated. In the run-in position shown in FIG. 4, the body 30 supports a bidirectional slip 32, which is disposed between an upper cone 34 and a lower cone 36. Wickers 33 and 35 are opposite to each other to secure the packer against loads from opposed directions. FIGS. 5 and 6 illustrate the cones in more detail. Each cone is cylindrically shaped with a tapered surface 38. The discussion of FIGS. 5 and 6 will focus on lower cone 36 and the lower end of slip 32, although it is equally applicable to the upper cone 34 and the upper end of slip 32. The slip 32 has a tapered surface 40 matching the angle of tapered surface 38 on cone 36. The cone 36 has a series of elongated slots 42 which extend from end 44 where the tapered surface 38 begins. Referring to FIG. 6, the orientation of slots 42 can readily be seen. Referring to FIGS. 7 and 8, it can be seen that the body 30 has a series of tabs 46, each one being disposed in slot 42 of the cone 36. Referring to FIG. 4, a slip cage 48 helps to retain the slips 32 and pull the cones from under the slips 32 for release. At its lower extremity 50, the slip cage 48 extends into grooves 52 of cone 36 (see FIG. 6).

The essential components of the thin slip system for high loads now having been described, its operation can be explained in greater detail. Setting the slips 32 involves relative movement with the result that cones 34 and 36 are brought closer together. Referring to FIGS. 5–8, as the slips are wedged against the tubular or casing 54, a radial load is transmitted through the slips 32 into the tapered surfaces 38 of each of the cones 34 and 36. In view of the fact that the cones, such as 36, have the elongated slots 42 with tabs 46 from body 30 extending therein, the radial load from the slips is transmitted through the cones, such as 36, and into circumferential loads on the tabs 46 extending from body 30. The load on the cone 36 from the slips 32 is illustrated by arrow 56 as acting on tapered surfaces 38. That force is in turn translated into opposed circumferential loads as indicated by arrows 58 (see FIGS. 6 and 8). Depending on the design parameters for the cone 36, varying amounts of movement of the segments of cone 36 between slots 42 can occur as a result of loading from the slips 32. The design of the cone 36 can be such that all of the applied load from the slips 32 can be transferred into the tabs 46 on body 30. The parameters which will dictate whether the load is taken entirely by tabs 46 or shared between tabs 46 and the remainder of the body 30 include the relationship of the width of slots 42 to tabs 46, as well as the thickness of the cone 36. The cone 36 can be designed to flex or somewhat buckle between slots 42 to come into a load-bearing relationship with the body 30 between the tabs 46. In the preferred embodiment, the radial loading from the slips 30 pushes the broad fingers defined between slots 42 sufficiently inwardly to make edge contact with the tabs 46 such that further loading radially from the slips goes directly to the tabs 46 on body 30.

Figure 2:
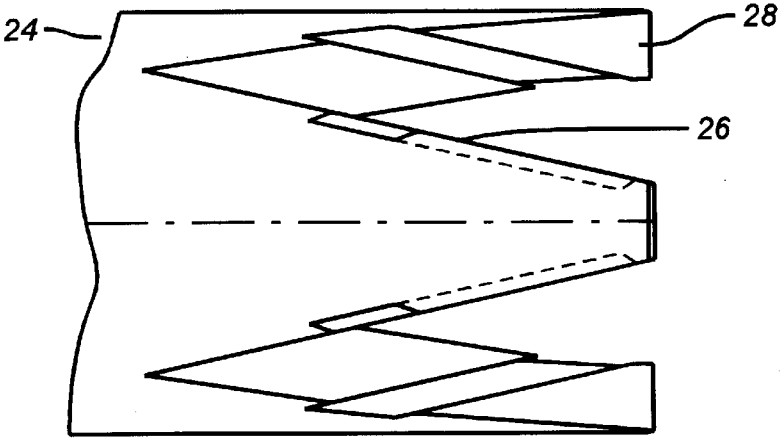
(PRIOR ART) FIG. 2
FIG. 2 is the cone to be used with the slips shown in FIG. 1 in the prior art, illustrating the matching surfaces to the beveled surfaces of the slip.
Figure 3:
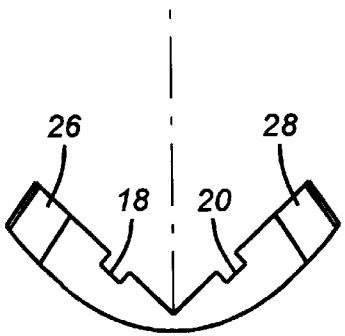
(PRIOR ART) FIG. 3
FIG. 3 is an end view of the cone in FIG. 2, again showing the disposition of opposed surfaces which accept the slip of FIG. 1.
Figure 1:
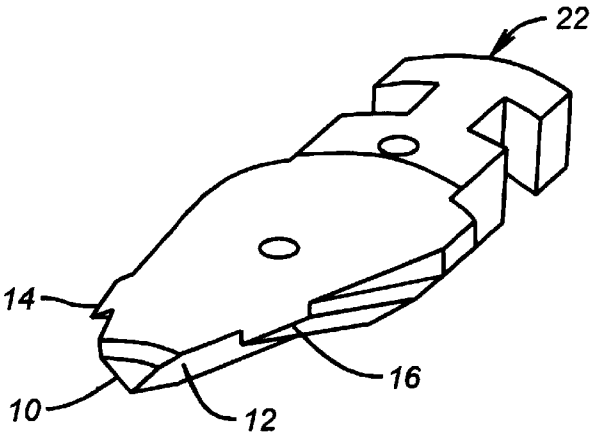
(PRIOR ART) FIG. 1
FIG. 1 is a perspective view of a slip, without wickers, of the prior art, showing opposed beveled surfaces.
Figure 4A:
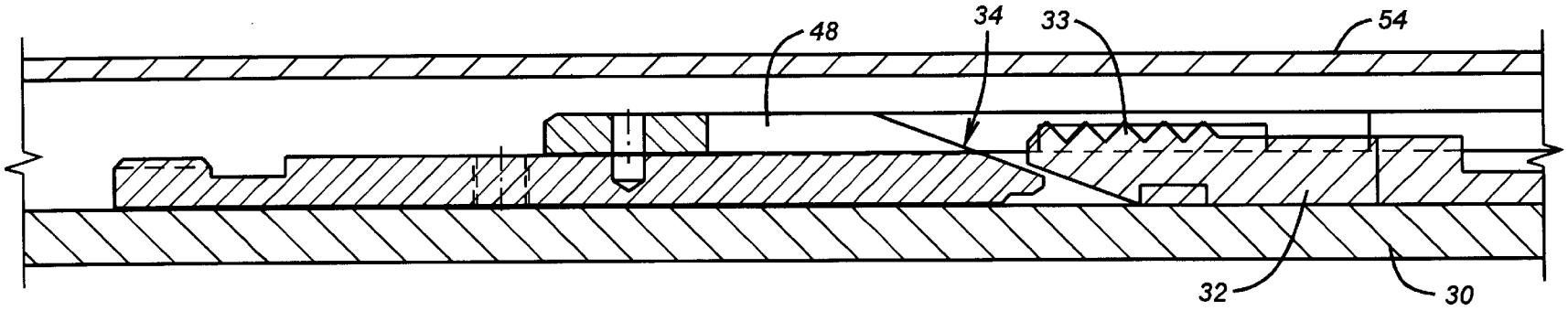
FIGS. 4*a–b* are a sectional view of the present invention shown in the run-in position.
Figure 4B:
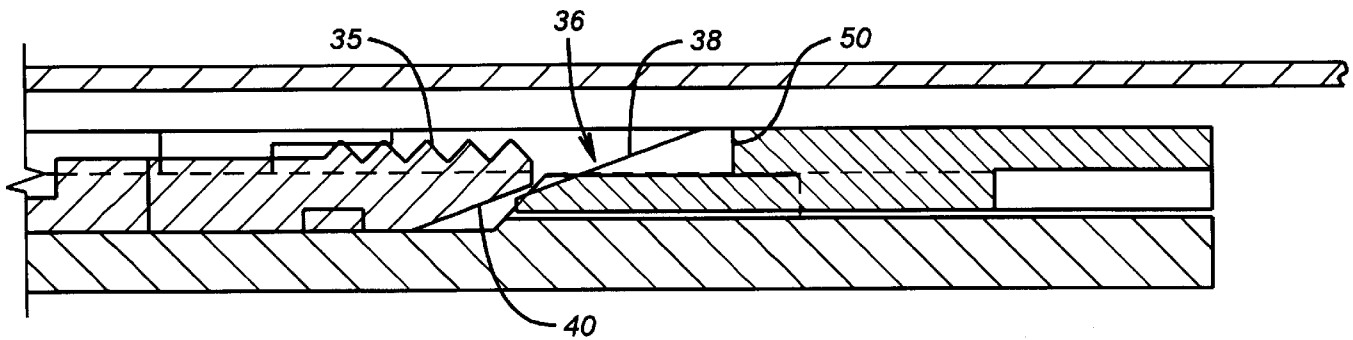
Figure 4C:
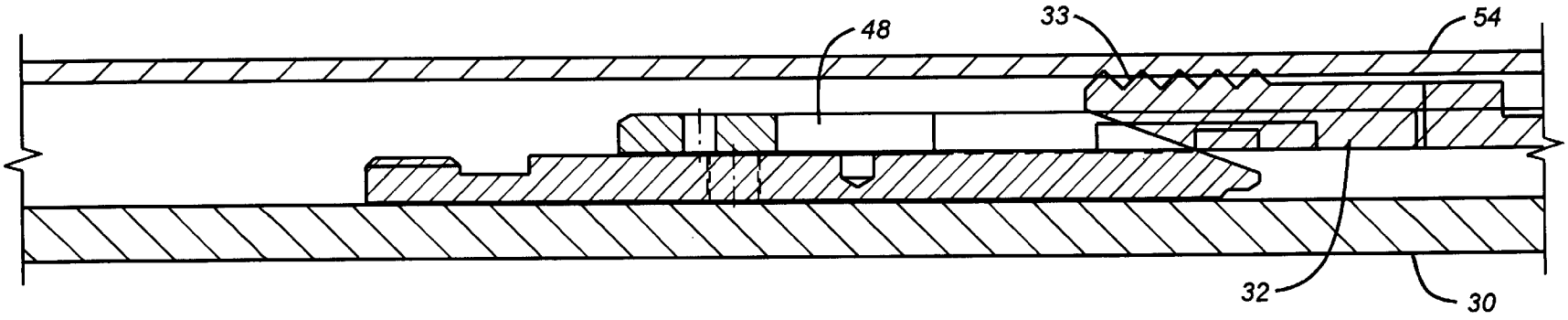
FIGS. 4*c–d* are the sectional view of the present invention shown in the set position.
Figure 4D:
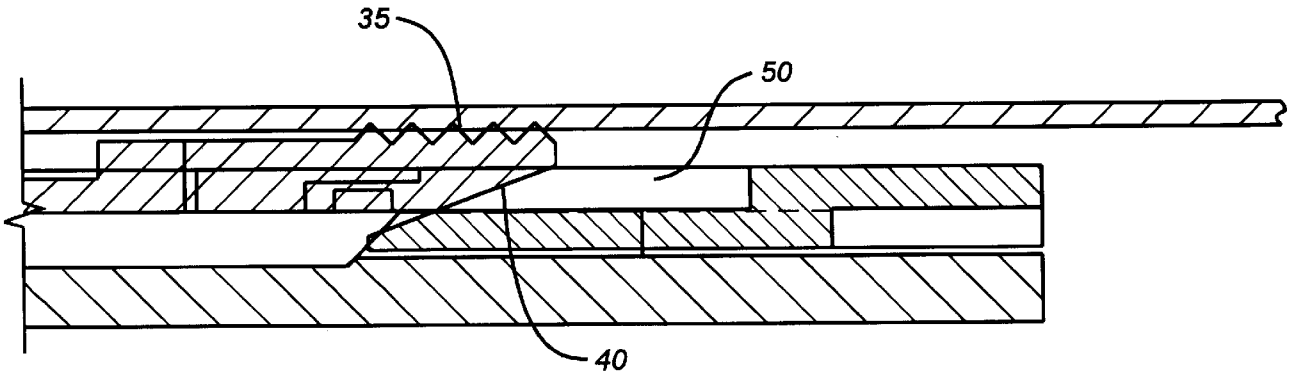

Those skilled in the art will appreciate that relatively thin slips can be used compared to those illustrated in the prior art, such as FIGS. 1–3. The cone configuration, such as for cone 36, permits the high loading with a thin slip by virtue of the use of the narrow slots 42. The cone 36 has greater structural rigidity for a given thickness than the designs for the cone shown in FIGS. 2 and 3. Because of the use of longitudinal slots 42, coupled with tabs 46, release of the slips from the casing 54 is also facilitated. The slips 32 do not tend to get stuck to the cone 36. The design illustrated for the cone in FIGS. 5 and 6 also separates the regions of loading from the slips at tapered surfaces 38 from the transfer of load to the body 30 via tabs 46 which extend into the narrow slots 42. There is, thus, less of a tendency to stick or jam the slips in the cone, as in the prior art FIGS. 1–3, where guidance of the slip and transfer of load from the slip to the cone occurred in close proximity. The capability of handling a high load comes from the ability to transfer load through the cone 36 into the tabs 46 appended to the body 30, as opposed to the design of FIGS. 1–3 where the slip loading was transferred entirely into the cone, where loading on the body in the design of FIGS. 1–3 only occurred upon complete collapse of the cone onto the body. In view of the configuration of the cone in FIGS. 2 and 3 to accommodate the slips shown in FIG. 1, limited loading was possible on the cone 24 before it would be collapsed.

As shown in FIG. 4, the slip system can employ a unitary slip with two cones, making the entire assembly shorter than the design shown in FIGS. 1–3, which required two distinct slips oriented in opposite directions with a slip ring in between to engage the T-shaped ends of the opposing slips. The designs depicted in FIGS. 4–8 are considerably cheaper to manufacture and provide a greater assurance of release, making the system of the present invention ideal for retrievable packers and bridge plugs requiring high differential loads.

The foregoing disclosure and description of the invention are illustrative and explanatory thereof, and various changes in the size, shape and materials, as well as in the details of the illustrated construction, may be made without departing from the spirit of the invention.

What is claimed is:

1. A slip system for a downhole tool to support the tool comprising:

a tool body having a longitudinal axis and at least one extending tab;

at least one slip movably mounted to said body;

at least one cone further comprising at least one slot with said tab extending into said slot, said cone movably mounted to said body and movable between said tool body and said slip to force said slip against a tubular and to transmit a radial reaction force directed toward said longitudinal axis from said slip through itself and at least in part circumferentially into a portion of said body through said tab.

2. The system of claim 1, wherein:

said cone flexes to transfer slip loading to said body.

3. The system of claim 2, wherein:

said cone comprises at least one taper at one end thereof;

said slip comprises a mating taper in contact with said taper on said cone.

4. The system of claim 3, wherein:

said at least one slot includes a plurality of slots.

5. The system of claim 4, wherein:

said slot extending longitudinally;

said body comprises at least one tab extending into said slot.

6. The system of claim 5, wherein:

said slot extending from said end of said cone comprising said taper.

7. The system of claim 5, wherein:

said slot narrowing in width responsive to a reaction force from said slip through said taper on said cone to transfer at least a portion of the load on said taper of said cone to said tab on said body.

8. The system of claim 7, wherein:

said cone moving radially toward contact with said body as said slot is narrowed into contact with said tab so as to divide the reaction force from said slip to both said tab and said body.

9. The system of claim 1, wherein:

said at least one slip comprises a plurality of slips;

said at least one cone comprises a pair of cones, said at least one slot of said cones each comprising a plurality of slots disposed thereon defining a plurality of fingers;

said body comprises a plurality of tabs extending into said slots;

said slips transmitting a reaction force from contact with the tubular radially to said fingers to flex said fingers into contact with said tabs.

10. The system of claim 9, wherein:

said fingers are also flexed into contact with said tool body.

11. The system of claim 9, wherein:

said slips further comprise opposing wickers on a singular slip body.

12. A slip system for a downhole tool to support the tool against a tubular downhole, comprising:

a tool body;

at least one slip movably mounted to said body;

at least one cone movably mounted to said body to force said slip against the tubular and to transmit a reaction force from said slip through itself and into a portion of said body;

said at least one slip comprises a plurality of slips;

said at least one cone comprises a pair of contes, each comprising a plurality of slots disposed thereon defining a plurality of fingers;

said body comprises a plurality of tabs extending into said slots;

said slips transmitting a reaction force from contact with the tubular radially to said fingers to flex said fingers into contact with said tabs;

said flexing of said fingers narrows said slot until opposed edges of said fingers contact a pair of tabs.

13. The system of claim 12, wherein:

said tabs are compressively loaded by said fingers.

14. The system of claim 13, wherein:

said fingers also contact said tool body as well as said tabs to share the reaction load from said slips.

15. The system of claim 9, wherein:

said pair of opposed cones are each configured with slots disposed between end tapers thereon; and further comprising:

a slip cage to retain said slips and to create relative movement between said cones to set and release said slips.

16. The system of claim 9, wherein:

said slots are disposed between end tapers on said cone.

* * * * *